US006102118A

United States Patent [19]

Moore

[11] Patent Number: 6,102,118

[45] Date of Patent: Aug. 15, 2000

[54] MULTI-PURPOSE ADJUSTABLE CENTRALIZER SYSTEM WITH TOOL

[76] Inventor: Curt A. Moore, 9269 Mission Gorge Rd., Suite 165, Santee, Calif. 92071

[21] Appl. No.: 09/223,362

[22] Filed: Dec. 30, 1998

[51] Int. Cl.[7] ..... E21B 17/10

[52] U.S. Cl. ..... 166/241.7; 405/259.1; 405/262

[58] Field of Search ..... 166/241.7, 381–385; 405/154, 262; 175/202

[56] References Cited

U.S. PATENT DOCUMENTS

| | | | |
|---|---|---|---|
| 1,402,786 | 1/1922 | Muehl | 175/202 X |
| 3,055,432 | 9/1962 | Park | 166/241.7 |
| 3,177,946 | 4/1965 | Hall | 166/241.7 |
| 3,566,965 | 3/1971 | Solum | 166/241.7 |
| 4,042,022 | 8/1977 | Wills et al. . | |
| 4,077,470 | 3/1978 | Dane . | |
| 4,143,713 | 3/1979 | Kreft . | |
| 4,247,225 | 1/1981 | Chickini et al. . | |
| 4,269,269 | 5/1981 | Wilson . | |
| 4,520,869 | 6/1985 | Svenson . | |
| 4,651,823 | 3/1987 | Spikes . | |
| 4,741,143 | 5/1988 | Foster, Jr. . | |
| 4,866,903 | 9/1989 | Ferstay . | |
| 4,892,144 | 1/1990 | Coone . | |
| 4,909,322 | 3/1990 | Patterson et al. . | |
| 4,955,755 | 9/1990 | Frey | 405/154 X |
| 5,197,542 | 3/1993 | Coone . | |

*Primary Examiner*—Dennis L. Taylor
*Attorney, Agent, or Firm*—Richard D. Clarke; George T. Parsons

[57] ABSTRACT

A novel centralizer system adaptable to virtually all known rock and soil anchoring applications. Most preferably made from a petroleum based material, the primary components to the centralizer include a plurality of straps and two collars at opposite ends of the straps. The straps are easily and manually inserted into slots in each of the collars. Each collar may be molded to provide slots for three or more straps. The collars are molded with grout passages between slots thereby allowing more than the required amount of grout to be fed through the centralizer. On a least one strap are molded two lock hold pins distally located along an outer edge of the strap yet before the point where the strap is inserted into each collar. A separate yet component tool is manually and virtually simultaneously placed over both lock pins. The tool is a narrow band of material punched with a plurality of holes and placed over both lock hold pins. The flexibility and compressibility of the straps allows for adaptability of the centralizer to various diameter bore holes. In addition, the flexibility of the straps permits easy manual assembly on-site without the use of conventional tools.

20 Claims, 8 Drawing Sheets

PRIOR ART

MULTI-PURPOSE ADJUSTABLE CENTRALIZER SYSTEM WITH TOOL

BACKGROUND OF THE INVENTION

1. Field of the Invention

The present invention relates generally to centralizer devices used in rock and soil anchoring applications. More particularly, the present invention relates to a novel centralizer device with an in-place component tool used to make optimized adjustments to the diameter size of the centralizer device for each of numerous applications 2. Description of the Related Art Centralizers are devices used to provide space between an anchorage and the walls of an anchor bore hole, thereby allowing grout to be injected into the bore hole for securing of the anchorage. The centralizer field includes many different inventions which have attempted to prove the functions of the centralizer. Its two primary functions are to: 1) provide space between the anchorage and the walls of the bore hole, and 2) to provide a locking mechanism for the several centralizer elements so that they do not fail once installed in the ground.

More specifically, Known relevant prior art has focused on improving the locking mechanism. Unfortunately, patented inventions in this field still exhibit many problems and disadvantages which the present invention has overcome. Even though previous designs have had some success in overcoming past problems, remaining problems include inflexibility in meeting multiple applications, relatively complex locking mechanisms, and using heavy materials such as steel. In addition, known prior art virtually neglects the problem of optimizing the space between the anchorage and the bore hole walls for each application. As is well known in the art, grout is used to secure the anchorage in a bore hole. The more secure the anchorage, the safer the entire anchorage, thereby minimizing the possibility of a failure of a dam, a transmission tower, or an oil well, or other anchor applications.

Therefore, it is clear that a need exists for an improved centralizer system that optimizes the spacing around the anchorage, provides a simple yet effective locking mechanism, allows use in multiple applications, is light weight, strong, and is even more cost effective than existing centralizers. The present invention overcomes these and many long-standing and even ignored problems and disadvantages of the prior art.

Some of the related prior art includes the following U.S. patents: Wills, et al. U.S. Pat. No. 4,042,022; Ferstay U.S. Pat. No. 4,866,903; Chickini, Jr. et al. U.S. Pat. No. 4,247,225; Dane U.S. Pat. No. 4,077,470; Wilson U.S. Pat. No. 4,269,269; Spikes U.S. Pat. No. 4,651,823; Patterson et al. U.S. Pat. No. 4,909,322; Svenson U.S. Pat. No. 4,520,869; and Kraft U.S. Pat. No. 4,143,713.

Wills, et al. discloses a centralizer device with a plurality of blades received in slots by a pair of cylindrical collars. This invention is directed towards preventing the separation of parts during use. Disadvantages to this design include the lack of flexibility in the blade material, a design directed to a specific dimension envelope for the centralizer, and an assembly requiring hammers to insert the steel blades, and therefore requiring a lengthy assembly time.

Ferstay discloses a one piece centering device for thread bars. The device has holes to allow grout to pass around or through the device. Disadvantages to this device include restricted applications because of its small size, and lack of an expanding feature to fit different size bore holes. The device seems directed to use only in building applications. Another disadvantages is the small size of the holes in the device to allow grout to pass. It appears that it would be difficult for grout to pass through the small holes in sufficient quantities to provide sufficient force transfer to the ground for a safe anchor. Still another disadvantage is the use with threaded bar. Installing the device takes more time than would an non-threaded device.

Chickini, Jr. et al. discloses an alignment device comprising a single component for mounting an anchor cable in an elongated cable hole in a guy line anchoring environment. One disadvantages with the device is the fixed diameter of the collar for passing cable through. Another disadvantage is the small diameter of the collar for passing any cable through. Still another disadvantage is the somewhat complex locking mechanism to prevent the device from coming apart.

Dane discloses a well centralizer directed to an improved means to connect bow elements to collars. Disadvantages to this device include a complex connecting apparatus, limited applicability in that it is for use only in oil well casings, use of relatively heavy steel for material, and also a need to bend the locking tab to allow for locking the bow elements into the collars.

Wilson discloses a deformable tab on collars as a means to prevent each spring from disengaging from the end collars when the centralizer is subjected to compressional loading. One disadvantage to this device includes limited applicability in that use is only directed to oil, gas, or water drilling situations. Another disadvantage is that the deformable tab does not appear to be of a robust design, therefore the tab is likely to break. Still another disadvantage is that numerous conventional tools, including hammers, vises and pipe wrenches are need for assembly. Yet another advantage is the metal material used requiring forging. The metal material, being relatively heavy compared to plastic, requires more costs for manufacture, crating and shipping. Spikes discloses a well bore centralizer directed to an improved connectible means between the bowed elements and the collars. Disadvantages include a complex collar locking design, bow elements set to a specific arcuate position, and the hammer force required for assembly. Still another disadvantage is the use of metal in the design, thereby requiring more costs for manufacturing, crating and shipping.

Patterson et al. disclose a casing centralizer with bendable tab to allow a more improved locking mechanism to secure the bow springs in the collars. Disadvantages to this device are similar to others listed in previously mentioned prior art. One advantage is the inability of the device to be flexible thereby limiting its applicability to only certain sizes of bore holes. Another disadvantage is the use of metal which increases costs for manufacture, crating and shipping. Yet another disadvantage mentioned in some of the other prior art is the need to bend the metal before the bow springs can be inserted into the collars. Bending the metal can create a point for failure after installation.

Svenson discloses a centralizer for a well casing directed specifically to a third channel of the collar compressible at final assembly allowing for locking of the bow and collar together. Disadvantages in using this device include the complex locking mechanism, limited use to well casings, use of metal requiring more costs, and a need to use hammering tools before assembly can be completed.

Kraft discloses a self-centering basket for use in mining or oil fields. More specifically, the device is directed towards lugs to hold down steel bars to prevent the bars from jumping out of engagement. Disadvantages include the use of steel, thereby increasing manufacturing and shipping costs. Because the design is meant to be locked upon assembly, no means are provided for mistakes in assembly. It would appear to be virtually impossible to disassemble to correct mistakes. In addition, no means are disclosed for altering the outer dimensions of the device should the on site diameter of the bore hole be greater or less than expected.

In summary, all the cited patents have a multitude of disadvantages. As is quickly realized, most of the patents disclose similar attempts to solve one problem with previous centralizer designs. Most are directed to improving locking techniques. However, problems still exist with attempts to improve locking techniques. Therefore, it is an object of the present invention to solve the locking problem with an elegant, simple, inexpensive design. In addition, the present invention solves other problems in the field that have been virtually ignored, Therefore it is an object of the present invention to provide a flexible design allowing adaptability in the field to different diameter bore holes. Also, the unique features of the present invention allow use in virtually any anchoring use. It is a further object of the present invention to use a non-metal material, thereby reducing costs throughout the manufacturing to end use process and eliminating the need for any use of conventional tools for assembly. Another object of invention is to provide numerous embodiments for optimized use in the field, including providing for errors in assembly, in customer specifications, or customer orders.

SUMMARY OF THE INVENTION the above-mentioned disadvantages, difficulties and problems of the prior art are overcome by the present invention. The present invention centralizer may be used in virtually all known rock and soil anchoring applications. Most preferably made from a petroleum based material, such as polyethylene or propylene, the centralizer is therefore both strong, lightweight and flexible. The components to the centralizer include a plurality of straps and two collars at opposite ends of the straps. The straps are easily and manually inserted into slots in each of the collars. Each collar, also most preferably made from a material such as polyethylene, may be molded to provide slots for three or more straps. Therefore the centralizer is adaptable to virtually any anchor application. The collars are molded with notches between slots thereby allowing more than the required amount of grout to be fed through the centralizer.

Preferably on a least one strap are molded two lock hold pins distally located along an outer edge of the strap yet before the point where the strap is inserted into each collar. These lock pins are unique in providing the means for locking the straps in place. A separate, yet component and easy to use tool is manually and virtually simultaneously placed over both lock pins. The tool is a narrow band of identical material, such as polyethylene, punched during manufacturing with a plurality of numbered holes. All but one hole are spaced from one end of the tool. Since the material of the straps is flexible, virtually any worker easily and manually can compress the centralizer to just short of the desired bore hole diameter, then he places the tool over both lock hold pins. The tension of the straps now provides the force to hold the tool on the lock pins during installation of the centralizer, and in place for the life of the anchor. Simultaneously, the tool keeps and locks the straps into the two collars because of the tension on each blade as inserted into each collar slot. Therefore the present invention has provided an elegant yet simple and inexpensive locking solution.

Also, with the locking feature, the present invention is adaptable to any anchor application, because the centralizer is flexible enough to be compressed to any desired outer envelope dimension. Even if errors are made in the ordering, the customer specifications or actual on-site bore hole dimensions are not as expected, the present invention is adaptable to the situation. For instance, if a bore hole is smaller than expected, one can decompress the straps. First, one increases the compression by manually forcing the strap ends towards each other. Next, with the reduced tension on the tool, one can easily remove at least one end of the tool from the lock hold pins. Then the strap compression can be adjusted, and the tool reinstalled over the lock hold pins in the new compressed strap position, by placing the tool over a different hole in the tool.

In addition, the flexibility of the straps allows for ease of assembly on location without the use of conventional tools. The individual straps are inserted into each collar manually. Once all straps are inserted in both collars, the centralizer is compressed manually by pushing from both ends, then locked as previously described. Therefore no separate non-component conventional tools are needed for assembly. Because of the molding process used and the material, costs for manufacturing, crating, and shipping are greatly reduced from the prior art devices. Additional novel design features in the present centralizer system will be discussed in the detailed description.

These, and other, features and advantages of the present invention are set forth more completely in the accompanying drawings and the following description.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein closely related elements have the same number but different alphabetical suffixes, and further wherein.

DESCRIPTION OF THE PREFERRED EMBODIMENTS

Figure 1:
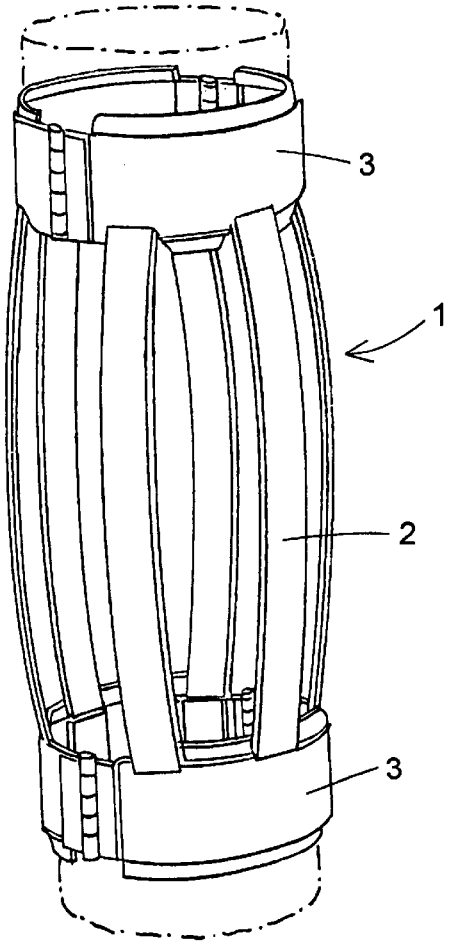
Fig. 1 PRIOR ART
FIG. 1 is a perspective view of a centralizer in the prior art, illustrating a blades and collar construction.

Referring initially to FIG. 1, a perspective view of an invention of the prior art is shown. A centralizer 1 is shown comprised of a plurality of straps 2 and two collars 3. This prior art (Spikes, U.S. Pat. No. 4,651,823) is generally representative of many of the cited prior art patents in the Background section above. The collars 3 show a complex metal hinged locking mechanism. The metal straps 2 are set to a specific arcuate position. The present invention makes novel improvements upon this prior art and those devices of the other patents cited.

Figure 2:
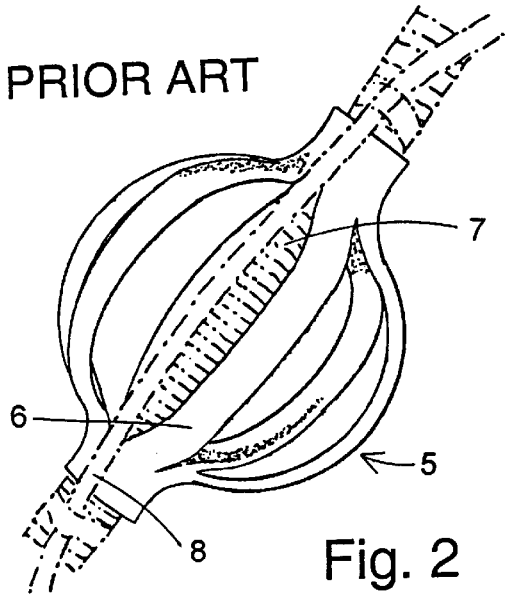
FIG. 2 is a perspective view of a typical PVC pipe derived centralizer as is currently constructed by convention, in place on a reinforcement bar (hereinafter "rebar") with a grout tube.

Referring now to FIG. 2, another prior art centralizer device 5 is shown here. This centralizer device 5 is derived from schedule 40 PVC pipe. During construction the PVC pipe is split and stretched apart to form the spacer members 6. It is shown in place on a "rebar", cable or strand 7 and having a grout tube 8 attached thereon.

Figure 3:
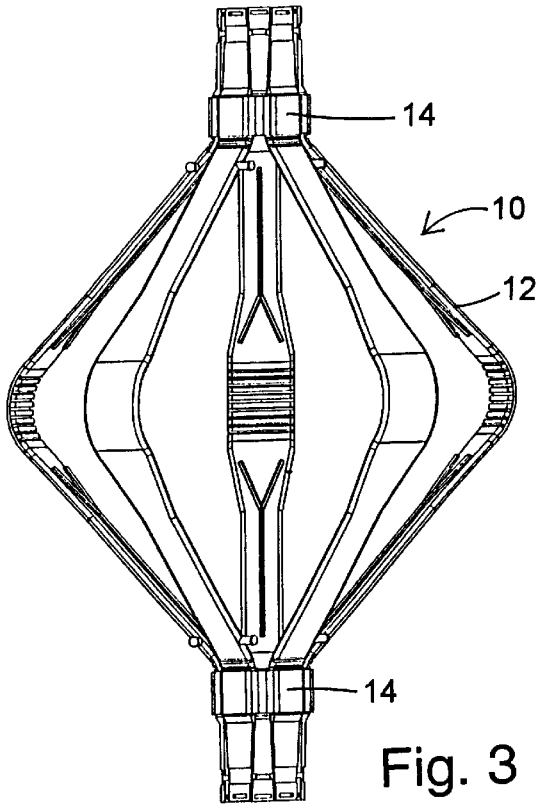
FIG. 3 is a perspective view of the present invention illustrating the straps and collars.

Referring now to FIG. 3, a perspective view of the present invention is illustrated. A centralizer system 10 is shown comprising two primary components; a plurality of straps 12 and two collars 14. The straps 12 are individually and manually insertable into each of the collars 14 to form the basic centralizer system 10. Details of each component will be described in detail based on subsequent drawings. Preferably, the centralizer system 10 (more conveniently titled "centralizer" from now on) is manufactured using polyethylene material. Other materials, such as polypropylene, may also be used. These materials are petroleum based and can be easily and inexpensively molded to produce manually flexible straps 12. Note that the straps 12 are shown in a flexed or slightly compressed position. This position highlights the novel feature of compressibility of the centralizer 10 without the use of any hammers, vises, grips, or other heavy or cumbersome conventional tools. Also, the simplicity of design is highlighted. As shown, only seven parts are required for this particular embodiment Other embodiments will be described later on in this detailed description. Each of the seven is a molded part, thereby minimizing manufacturing time, minimizing manufacturing cost, and minimizing part count for assembly.

Figure 4:
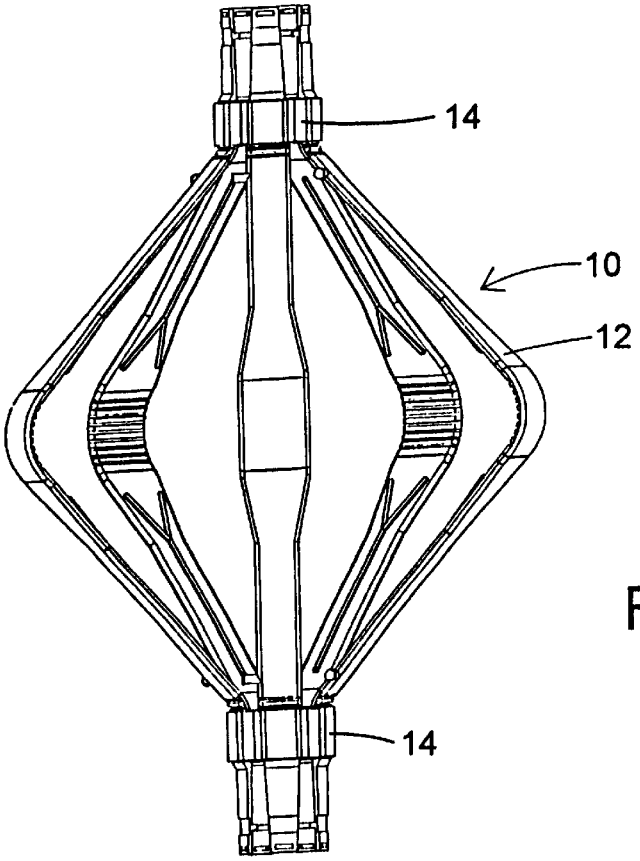
FIG. 4 is a perspective view illustrating the straps and collars, yet rotated slightly clockwise from the view of FIG. 3.

Next, referring to FIG. 4, a perspective view illustrating the straps 12 and collars 10 is shown, yet rotated slightly clockwise from the view of FIG. 3. The slight rotation allows the viewer to confirm various features of the straps 12 and to see their virtual identical design.

Figure 5:
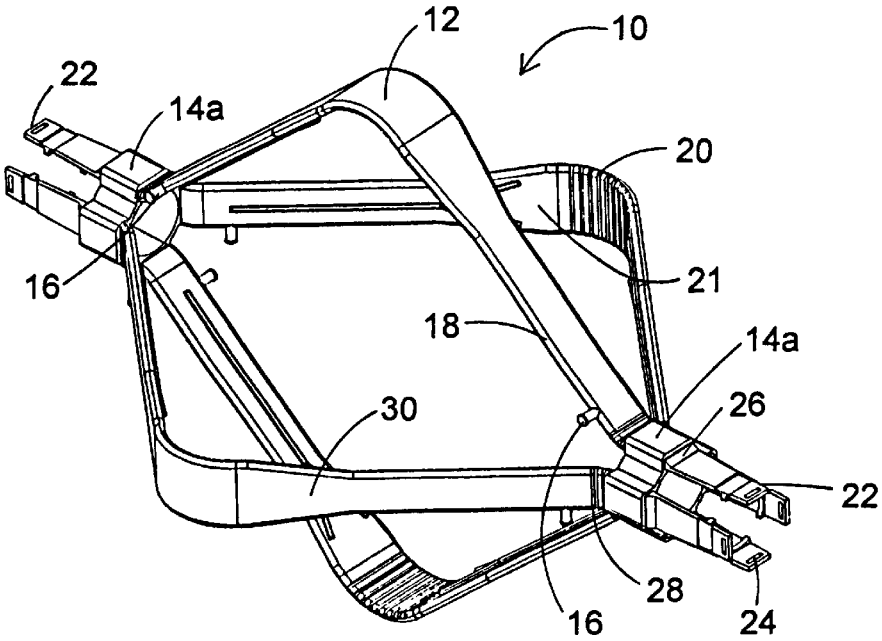
FIG. 5 is a perspective view illustrating the straps and collars, yet tilted slightly away from the viewer to more clearly show the collars of FIG. 3.

Referring to FIG. 5, a perspective view is shown tilted slightly away from the viewer to more clearly see other novel features of the straps 12 and the collars 14. A second embodiment of the centralizer 10 is also shown with four straps 12 instead of the five shown in FIG. 3 and FIG. 4. Collars 14*a* are molded to allow for four straps 12 instead of five. Each of the collars 14 is generally cylindrical in shape. Although prior art shows a plurality of straps, (otherwise identified as blades or bows) the present invention clearly and intentionally provides the novel advantage of various collar designs to accommodate a plurality of straps 12 as needed by the customer, or the application, or immediate on-site need. Also clearly evident, the present invention provides for differing quantities of straps 12 (that is, different embodiments of the centralizer 10) to meet the needs of the customer, application, or on-site need. In fact, because of the minimal cost of the components, another advantage to the customer is that he can order a kit of extra components in case they are needed on-site, and still save money.

Another novel feature clearly shown in FIG. 5 is a lock hold pin 16, one of several novel locking mechanisms. The lock hold pin is a crucial feature to not only 1) lock in the straps 12 to the collars 14*a*, but 2) to allow for flexibility and adjustability in matching the centralizer 10 to the actual bore hole on-site. No other known prior art provides this elegantly simple yet crucial capability. The lock hold pin 16 comes in a set of two on a same edge 18 of each of the straps 12 and proximate to the center portion of each of the straps 12, yet distally separated from each other. The multiple sets of pins 16 allow more flexibility to the user to lock the straps 12 in place. He does not have to turn the centralizer 10 or search for the lock hold pins 16. The pins 16 will be virtually in front of the user at all times for ease of use. The pins 16 are used in conjunction with a component tool to be shown in a subsequent figure and described later.

Another novel feature of the present invention is the use of a plurality of notches 20 on a bottom side 21 of each of the straps 12. The notches 20 are molded into the straps 12 in approximately the center of each of the straps 12. Because of the inherent strength of the molded polyethylene or other similar material, the notches 20 do not degrade the strength of the straps 12. On the contrary, the notches 20 provide additional flexibility to the straps 12 for ease of compression of the centralizer 10.

Continuing with the description of FIG. 5, each of the straps 12 has two slotted ends 22. Each of the slotted ends 22 has a rectangularly shaped slot 24 punched completely through each slotted end 22 and located proximate to the end of each of the straps 12. The purpose of the slotted ends 22 are to allow the installer of the centralizer 10 to have a means to grip the centralizer 10 to pull each centralizer 10 along any steel bar, cable or bundle of cables used in an anchorage. Another purpose of the slotted ends 22 is to be used as a tie wire retainer to fasten the centralizer to the rebar, cable or rebar encapsulated within corrugated pipe.

Again in FIG. 5, two tapered rises 26 are molded integrally into each of the straps 12. The tapered rises 26 stretch across the entire width of the straps 12. In addition, the rises 26 are molded in generally close proximity from each of the slotted ends 22. The purpose of the rises 26 is to provide another locking means to hold the straps 12 in the collars 14*a*. Once the slotted ends 22 are manually pushed through the collars 14*a*, the tapered rises 26 prevent the straps 12 from being easily pulled back through the collars 14*a*. Manually pushing the ends 22 overcomes the friction encountered as the tapered rises 26 meet each of the collars 12. Conversely, to remove the straps 12 from the collars 14, each of the tapered rises 26 stops when encountering the collars 14, thereby preventing said straps from easily being removed from the collars due to the friction of the rises 26 against the collars. Only through more aggressive manipulation or bending of the straps 12 can the straps 12 be removed from the collars 14.

Continuing with FIG. 5, another novel feature is shown. A third feature adds to the flexibility and adaptability of the centralizer 10. The first two flexible features are the material of the straps 12 and the notches 20 on the bottom side 21 of each of the straps 12. The third novel feature is a set of collar notches 28 on the top side 30 of each of the straps 12. The collar notches 28 aid in allowing the compression of the straps 12 as needed.

Figure 6:
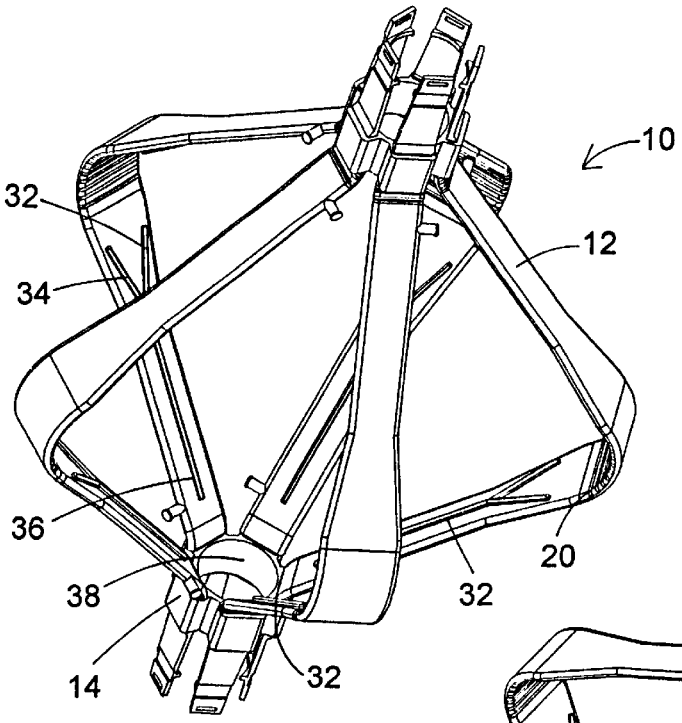
FIG. 6 is a perspective view illustrating the straps and collars, yet tilted slightly towards the viewer to more clearly show slight compression of the straps of FIG. 3.

Now referring to FIG. 6, a perspective view illustrates the straps 12 and collars 14, and other novel features, yet the centralizer 10 is tilted slightly towards the viewer to more clearly show slight compression of the straps 12 of FIG. 3 and FIG. 4. Also note that this FIG. 6 shows the first embodiment of the centralizer 10, that having five straps 12. In addition, another novel feature is shown as part of the straps 12. Two Y-shaped gussets 32 are integrally molded into each of the straps 12. The purpose of the gussets 32 is to add stiffening strength to each of the straps 12. One of the gussets 32 is molded into either side of the notches 20 on the bottom side 21 of the straps 12. In FIG. 6, only one of the gussets 32 is visible on each of the straps 12. More specifically, a "Y" portion 34 of the gussets 32 is in close proximity to the notches 20, while a base portion 36 of the gussets 32 is in close proximity to one of the collars 14.

In further describing FIG. 6, a clearer view of the collars 14 is seen. A cylindrical-shaped inner diameter 38 of one of the collars 14 is shown. With this view of the diameter 38, it is clear that a rebar, cable or bundle of cables, or encapsulated of same passes through the collars 14 at this location. Having the two collars 14 relatively closely spaced from each other provides a means to maintain the cables in a relatively straight line. If necessary, the centralizer 10 can be compressed or extended to allow the cables to bend slightly.

Figure 7:
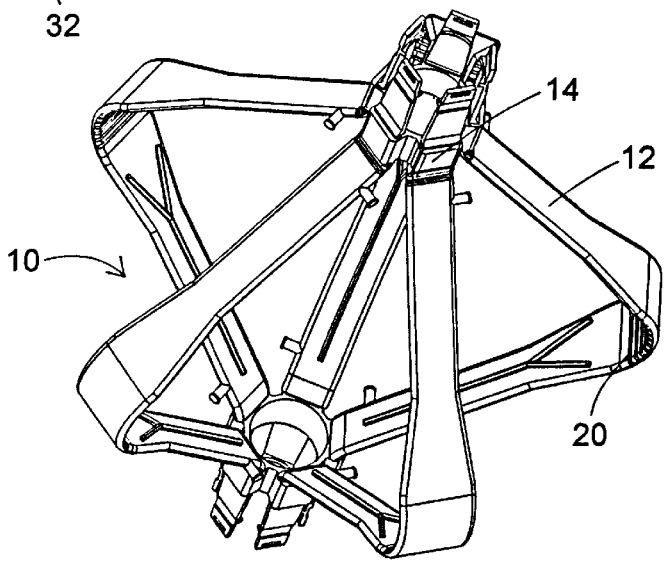
FIG. 7 is a perspective view illustrating the straps and collars, yet tilted slightly towards the viewer to more clearly show greater compression of the straps of FIG. 6.

Now referring to FIG. 7, another perspective view of the centralizer 10, yet tilted slightly towards the viewer, clearly shows greater compression of the straps 12 when compared to FIG. 6. Note how the notches are pushed further outward from the centerline of the collars 14.

Figure 8:
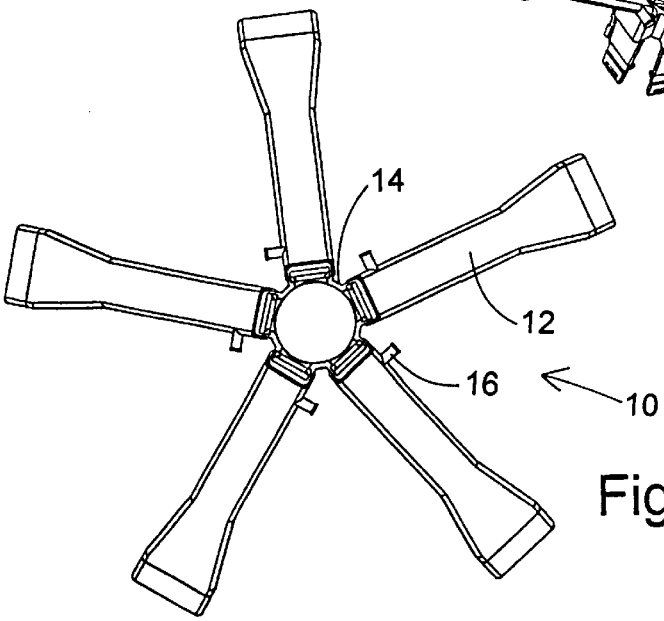
FIG. 8 is a plan view illustrating compressed straps inserted into one collar.

Next referring to FIG. 8, a plan view of the centralizer 10 illustrates compressed straps 12 inserted into one of the collars 14. Also clearly seen are the lock hold pins 16 on each of the straps 12.

Figure 9:
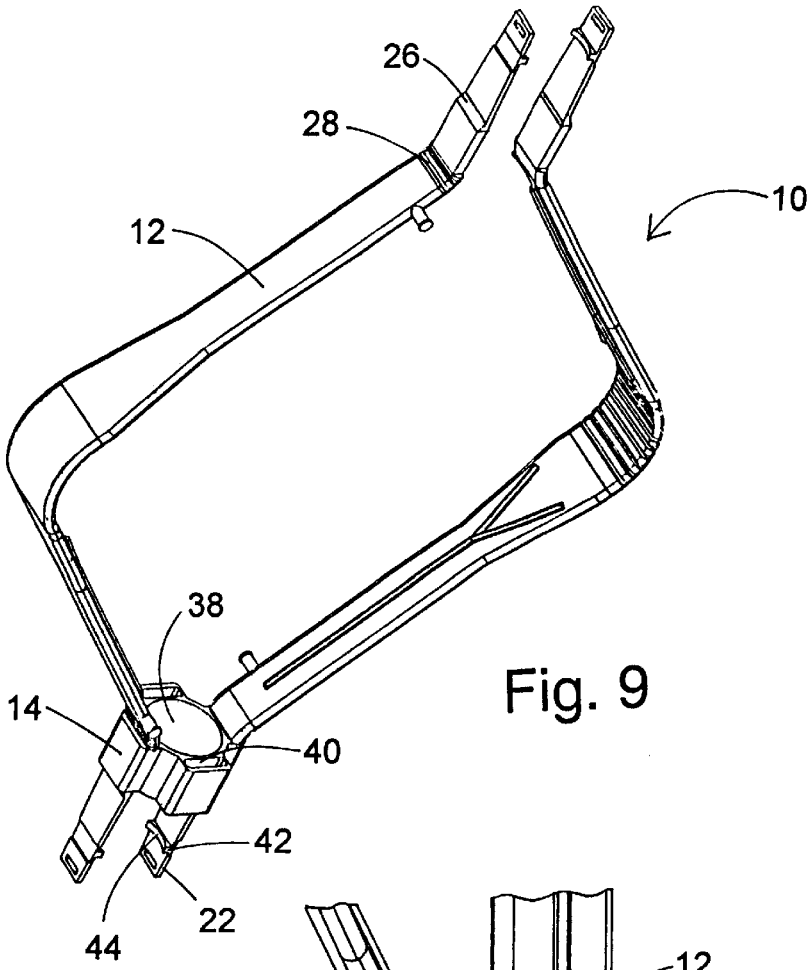
FIG. 9 is an enlarged partial perspective view of the present invention illustrating detailed features of a typical strap.

Referring to FIG. 9, an enlarged partial perspective view of the centralizer 10 illustrates detailed features of one of the typical straps 12 and one of the collars 14. A clearer view of the tapered rise 26 is seen. Also, a clearer view of the collar notches 28 is shown. The inner diameter 38 of one of the collars 14 is again shown. The inner diameter 38 dimension is determined by the anticipated applications and cable or cable bundle diameters. Obviously, a certain clearance space is needed between the outer diameter of a cable bundle and the inner diameter 38 of the collars 14 so that the cables can pass relatively easily through the collars 14. The design of the collars 14 and the molding process allow for manufacturing collars 14 of many different dimensions for the inner diameters 38. The inexpensive nature of the molding process, and the inexpensive raw material of the centralizer 10 all provide additional advantages to the present invention, allowing for lower overall costs to the user. Known prior art typically made from metal, such as steel, would cost more than the present invention because of the prior art's added weight, increased difficulty in manufacturing the metal parts, and the inconvenience of attempting to provide more than one diameter metal collar to house a plurality of straps.

Continuing with describing FIG. 9, a collar slot 40 is clearly shown as part of each of the collars 14. The rectangular collar slot 40 is molded into the collars 14 during manufacture. More specifically, each of the collar slots 40 is molded onto the outside of the inner diameter 38 of each of the collars 14. Additionally, each of the collar slots is symmetrically spaced around the circumference of each collar 14. Depending on the application, three or more collar slots 40 may be provided. FIG. 9 shows a partial view of the second embodiment using four straps 12. As is also clear from this FIG. 9, each of the straps 12 is inserted individually and manually into each of the collar slots 40. As was described previously, the tapered rises 26 encounter the collars 14 providing one of the locking mechanisms. More specifically, the tapered rises 26 encounter the collar slots 40. Easily manually inserted into the collar slots 40, the straps 12 cannot easily be removed from the collar slots 40 because of the additional friction of the tapered rises 26 against the collar slots 40.

Also in FIG. 9, an additional novel feature is shown. Proximate to the slotted end 22, a molded cable guide 42 is provided on each of the straps 12. Each cable guide 42 has a radial cut 44 to allow easier passage and guidance to an individual cable or a cable bundle passing through the collars 14. Additionally, the radial cut 44 accommodates either smooth surfaces, threaded or corrugated cable surfaces. Therefore, no need exists to provide a threaded inner diameter 38 as is found in cable passages in some prior art. These features that allow for easy passage of cables are a novel improvement over known prior art patents that disclose a non-smooth inner diameter to their collars. A non-smooth surface obviously would impede the passage of cables.

Figure 10:
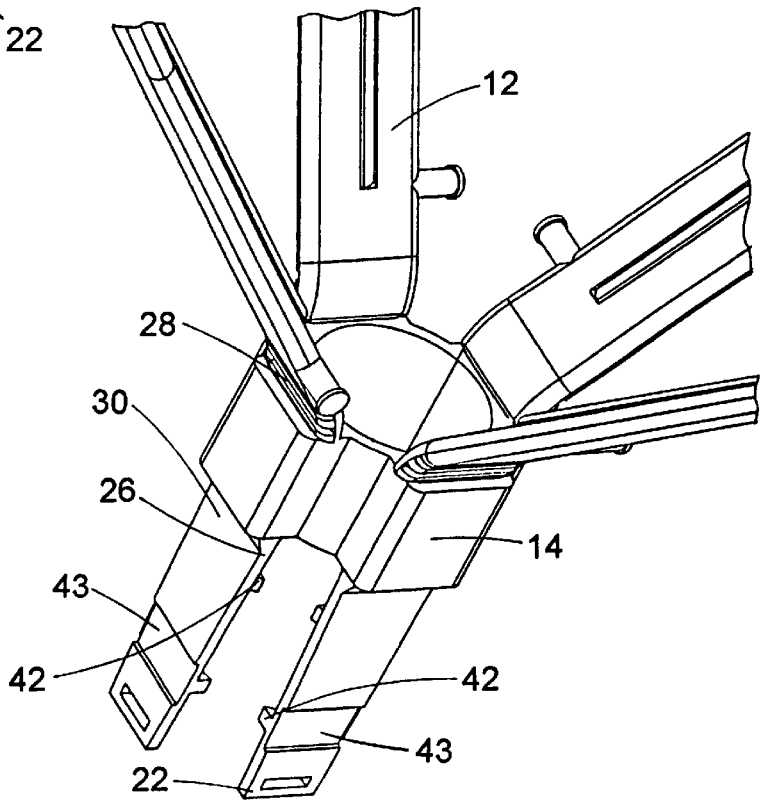
FIG. 10 is a greatly enlarged perspective view illustrating strap detail as inserted in one collar.

Referring now to FIG. 10, a greatly enlarged perspective view is shown which illustrates design details of straps 12 as inserted in one of the collars 14. FIG. 10 is an enlargement of a portion of FIG. 5. More specifically, enlargements are shown for the tapered rise 26, the collar notches 28, and the cable guides 42. Note that FIG. 9 shows two cable guides 42 on each of the straps 12, whereas FIG. 9 did not show the two cable guides 42 as clearly.

An additional novel feature and advantage to the design of the straps 12 is a securing slot 43 on the top side 30 on each of the straps 12. The securing slot 43 is centered on the cable guide 42 which is on the reverse side of the straps 12 from the securing slot 43. More specifically, each of the securing slots 43 is proximate to the slotted end 22 on each of the straps 12. The purpose of the securing slot 43 is to enable the user to even more securely lock the centralizer 10 onto the cable. Because of the flexibility of the straps 12, the slotted ends 22 can be cinched down, that is, brought closer together, using one of several securing means, such as tape of strapping quality, tie wire, zip ties, or band screw type straps. By wrapping the straps 12 using the securing slot 43, the centralizer 10 is virtually unable to slip along the cable after installation. Therefore, the various novel locking mechanisms described or mentioned so far include at least the following: lock hold pins 16, a locking tool (described in FIG. 15), a tapered rise 42 on each of the straps 12, and a securing notch 43.

Figure 11:
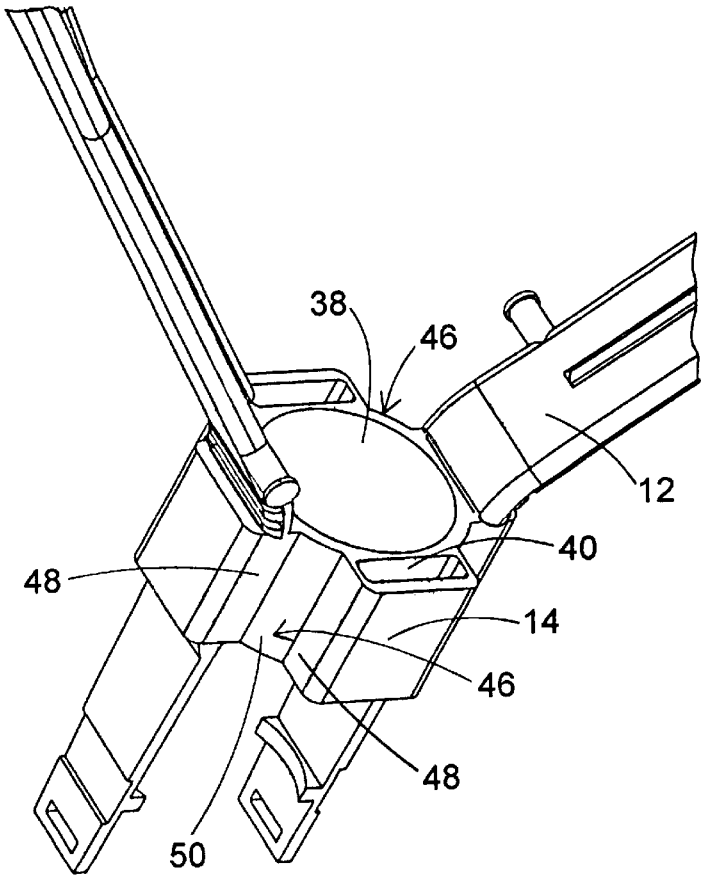
FIG. 11 is a greatly enlarged perspective view illustrating additional strap detail as inserted in one collar.

Next referring to FIG. 11, a greatly enlarged perspective view of a portion of FIG. 9 is shown. The specific and new novel feature illustrated clearly in this FIG. 11 is a design feature of the collars 14. A grout passage 46 is formed from three portions of other portions of the collars 14. Adjacent collar slots 40 have slot sides 48 that form two parts of the grout passage 46. The third portion of the grout passage 46 is formed from an arc 50 of the collars 14. Because of the plurality of collar slots 40, a plurality of grout passages are formed in each collar 14. For instance, one of the collars 14 may have three collar slots 40. Therefore, three grout passages 46 are formed in each of the two collars 14. With each increase in the number of collar slots 40, an equal number of grout passages 46 are formed. This grout passage 46 is another novel feature of the present invention because known prior art either provides minimal room for the grout or does not address the need at all. As previously highlighted, grout is crucial to the stability and safety of an anchor. Sufficient grout needs to be surrounding the cable or cables and the centralizer to provide a safe anchor installation. Also, because the anchor may need to be deeply imbedded in the ground or other material such as concrete, the room or passage for grout must be adequate to allow grout to be pumped throughout the entire length of the anchor. The present invention allows this passage.

Figure 12:
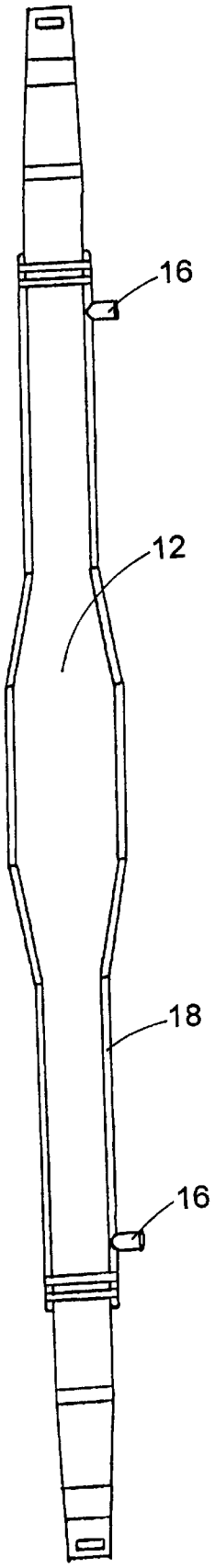
FIG. 12 is a plan view of a typical strap more clearly illustrating the lock hold pins.

Referring to FIG. 12, a plan view of one of the typical straps 12 more clearly illustrates the two lock hold pins 16 on the same edge 18 of the straps 12. The dimensions of each of the straps may and will vary depending on the application. Specifically, the overall length is determined by the size of the bore hole. The greater the size of the hole, the greater the length of the straps 12. The reason for greater length is because the centralizer 10 when compressed would need longer straps 12 that when compressed would flex outward and reach the outer diameter of the bore hole. The centralizer needs to hold the cable essentially in the center of the bore hole. Therefore, the straps 12 need to flex equally towards the outer diameter of the bore hole.

Figure 13:
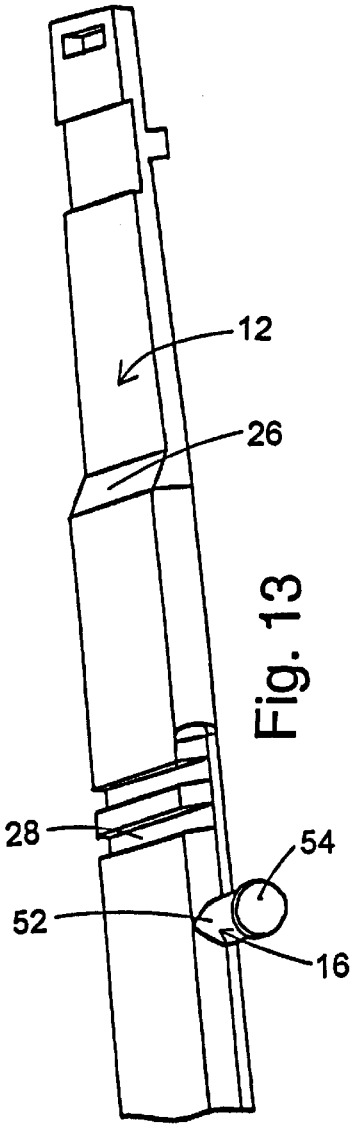
FIG. 13 is an isometric plan view of a typical strap.

Now referring to FIG. 13, an isometric plan view of one of the typical straps 12 shows several features slightly more clearly than the plan view of FIG. 12. The slotted end 22 is shown, as is the tapered rise 26 and the collar notches 28.

Figure 14:
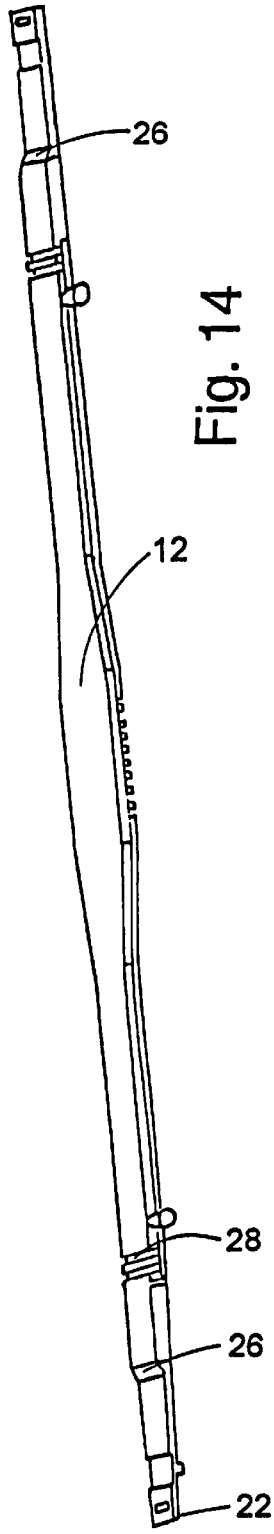
FIG. 14 is an enlarged top isometric view clearly illustrating strap end detail.

Next, referring to FIG. 14, an enlarged top isometric view of one of the straps 12 clearly shows more details of the end of one of the straps 12. Specifically, the tapered rise 26 is again shown. Also, the collar notches 28 are shown. Finally, additional components of the lock hold pins 16 are illustrated. Each of the lock hold pins 16 has a pin column 52 upon which is molded a pin cap 54. The pin cap 54 has a slightly greater diameter than the pin column 52. The design requirement for a greater diameter was to allow a component tool (to be described in a later figure) to catch on the pin cap 54 and not slip off the lock hold pin 16.

Figure 15:
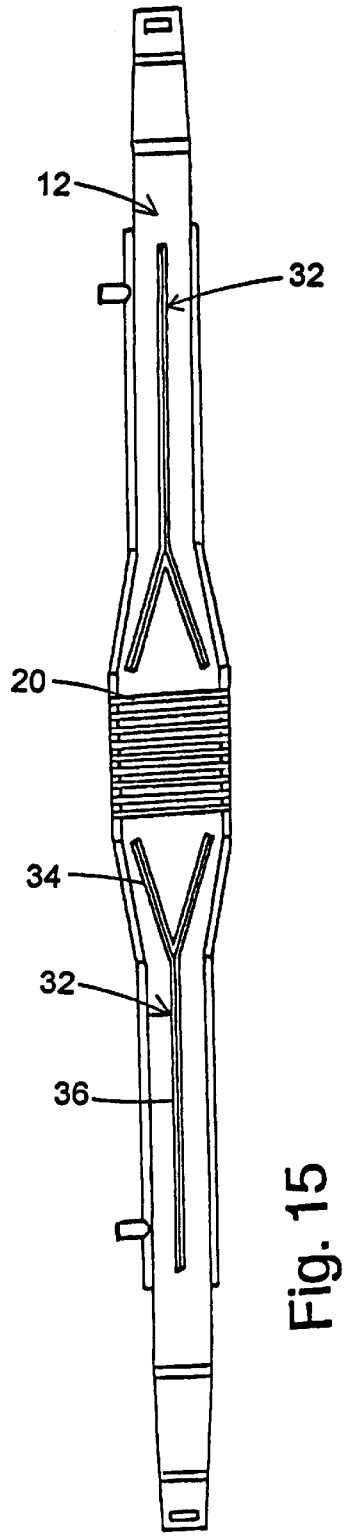
FIG. 15 is a bottom isometric view clearly illustrating typical strap construction details.

Referring to FIG. 15, a bottom isometric view clearly illustrates the relationship between the gussets 32 on the straps 12. As previously described, one of two gussets are integrally molded into each of the straps 12 on each side of the notches 20 in the center portion of each of the straps 12. Shown also are the "Y" portion 34 and the base portion 36 of each gusset 32.

Figure 16:
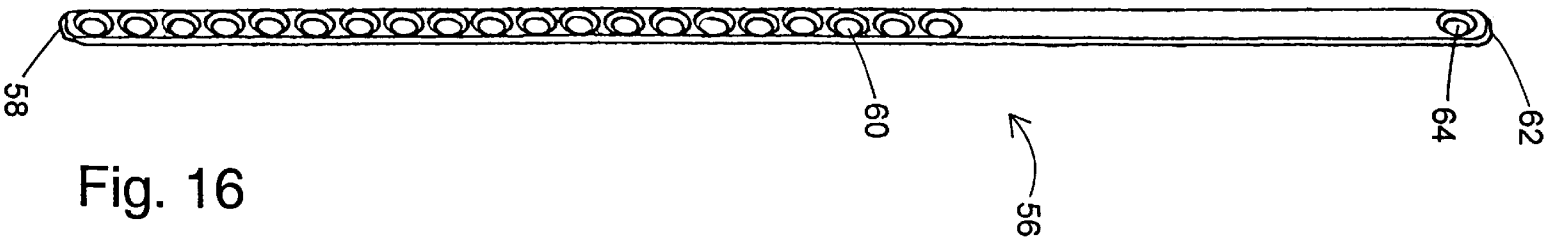
FIG. 16 is a perspective view of the locking tool.

Referring now to FIG. 16, a perspective view of a locking tool 56 is shown for the first time. This elegantly simple tool 56 is comprised of identical material as the centralizer 10. The polyethylene or similar material is molded into a thin strip of material, then punched to form a plurality of holes. At a first end 58, a plurality of holes 60 are formed through a punching step in the manufacturing process. These holes 60 are formed identically and in serial fashion one after another from the first end 58 towards a second end 62. The series of holes 60 stop approximately after the midpoint of the tool 56. At the second end 62, a single hole 64 is formed through the identical punching step. The purpose of the plurality of holes 60 is to allow the user to choose the appropriate individual hole to place over one of the lock hold pins 16 shown on other figures. The holes may be numbered to ensure consistency of the overall diameter of the centralizer when in use with multiple centralizers attached to the same "rebar", strand, corrugated pipe, cable or bundle of cables. The user also places the single hole 64 over the other one of the lock hold pins 16 on one of the straps 12 (shown on other figures). The choice of which individual hole of the plurality of holes 60 to use is dictated by the amount of compression needed of the centralizer 10 to match a specific diameter bore hole.

Figure 17:
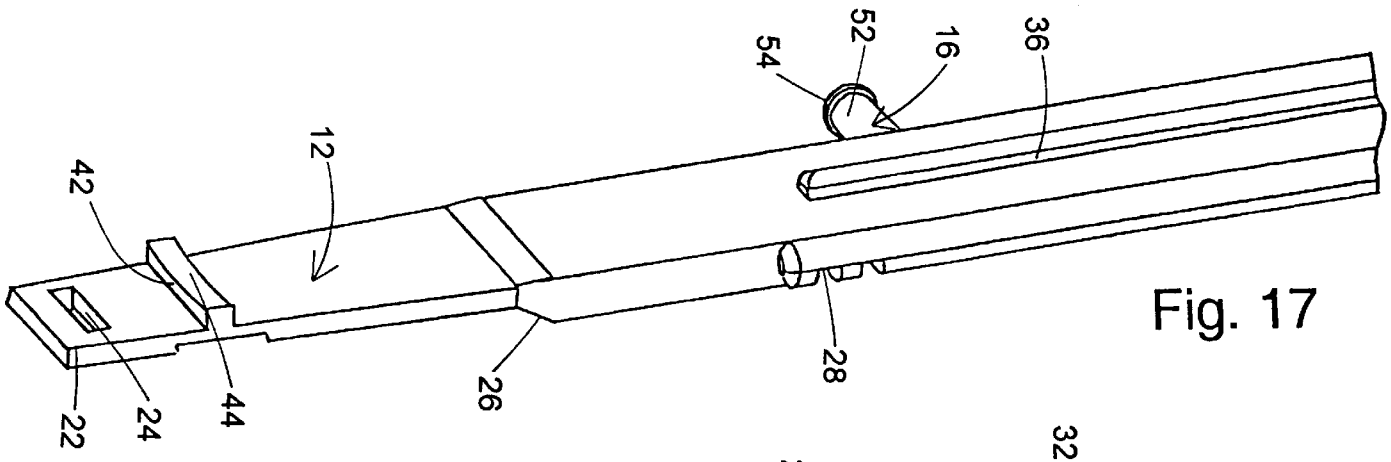
FIG. 17 is a greatly enlarged bottom view of construction details of the end section of a typical strap.

Referring to FIG. 17, a greatly enlarged bottom view is seen showing construction details of an end section of one of the typical straps 12. From the left end of the strap 12 is seen the slotted end 22 followed by the slot 24 formed from a punching step during manufacture. Next is seen the integrally molded cable guide 42 with the radial cut 44 for guiding cable smoothly. Following in order, next is seen the taper rise 26 which allows for a snap fit of the straps 12 into each of the collars 14 (not shown in this FIG. 16). Collar notches 28 are next. These notches 28 allow for flexibility in the straps 12 and easier fit of the straps 12 into the collars 14 (not shown). A portion of one of the gusset bases 36 is also shown. Finally, one of the lock hold pins 16 is seen with the pin column 52 topped by the pin cap 54. More clearly shown in this FIG. 16 is that the pin cap 54 has a greater diameter than the pin column 52. You will recall that previous discussion on FIG. 15 highlighted the importance of the pin cap 54 in helping to hold the locking tool 56 on the lock hold pins 16.

Figure 18:
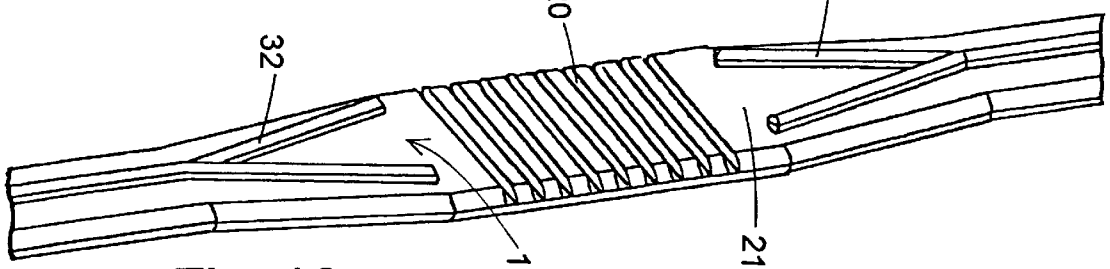
FIG. 18 is a greatly enlarged bottom view of a typical strap illustrating construction details of the center section.

Next, referring to FIG. 18, a greatly enlarged bottom view of one of the typical straps 12 is shown. The bottom side 21 shows the notches 20 in a typical center section of the straps 12. In addition, the gussets 32 are shown. Depending on a specific application, the straps 12 are made to different lengths. Therefore, the gussets 32 are also molded integrally into the straps 12 in different lengths to provide sufficient stiffening for each of the lengths of the straps 12.

Figure 19:
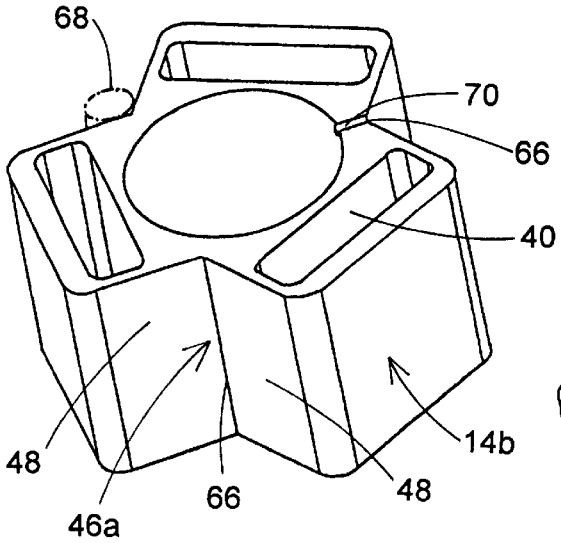
FIG. 19 is an enlarged perspective view of one embodiment of a typical collar illustrating three slots for straps and other details.

Referring now to FIG. 19, an enlarged perspective view of a third embodiment **14*b* of one of the collars 14 is shown. This embodiment 14*b* provides three collar slots 40 for three straps 12. In addition another embodiment of the previously described grout passage is shown. Describing FIG. 10, the grout passage 46 had three portions. The present embodiment 46*a* of the grout passage 46 has two portions. As before, two of the portions are slot sides 48. In this embodiment 46*a*, the slot sides 48 meet at angle 66. In either grout passage 46, 46*a*, a housing 68 may be laid to house a cable strand or to provide an additional passage way for grout through a grout tube. In fact, such a housing 68 may be laid in between any two adjacent collar slots 40** in any collar or grout passage embodiment.

Still describing FIG. 19, still another embodiment of the collars 14 may be used. At the angle 66, a slit 70 may be cut into one or more of the collars 14 to allow a user to manually spread the collar to snap over an anchor "rebar", rebar or strand encapsulated with corrugated pipe, or cable. This embodiment may be immensely practical and advantageous depending on the application on-site. The slit 70 may even be made on-site. Only one such slit 70 may be made in each of the collars 14 or else collar strength will be degraded.

Figure 20:
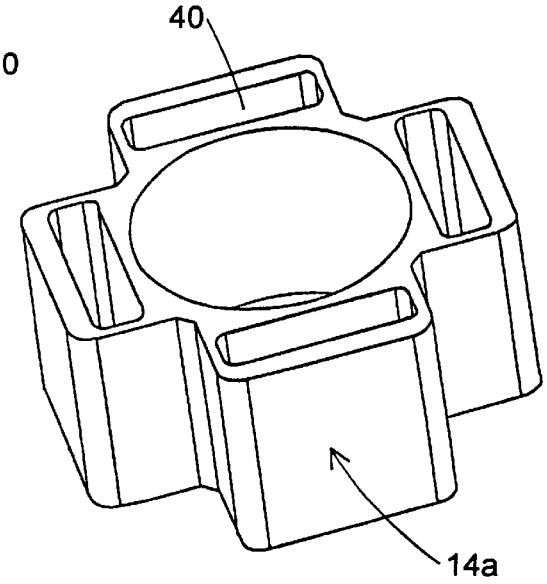
FIG. 20 is an enlarged perspective view of a second embodiment of a typical collar illustrating four slots for straps.

Referring to FIG. 20, an enlarged perspective view of a second embodiment 14*a* of one of the typical collars is shown. This embodiment 14*a* has four slots 40 for four straps 12.

Figure 21:
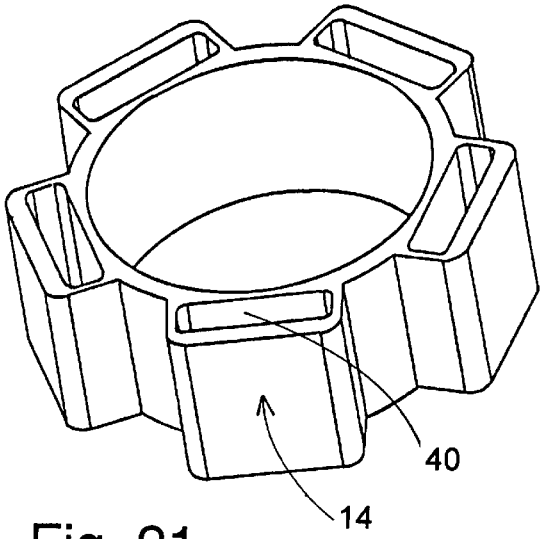
FIG. 21 is an enlarged perspective view of a third embodiment of a typical collar illustrating five slots for straps.

Next referring to FIG. 21, an enlarged perspective view of a preferred embodiment 14 of one of the typical collars is shown. This embodiment 14 has five slots 40 for five straps 12.

Figure 22:
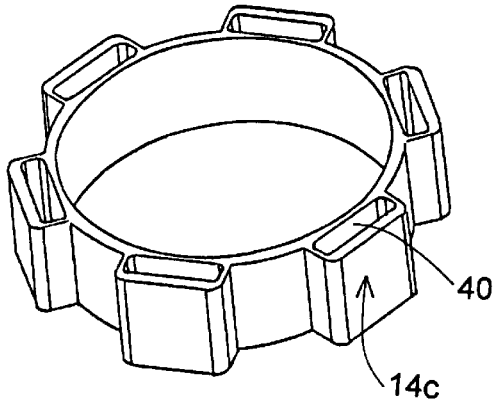
FIG. 22 is an enlarged perspective view of a fourth embodiment of a typical collar illustrating six slots for straps.

Finally, referring to FIG. 22, an enlarged perspective view of another embodiment 14*c* of one of the typical collars is shown. This embodiment 14*c* has six slots 40 for six straps 12.

Table 1. below illustrates the centralizer strap length and applicable working diameters for two configurations of straps. Of course, strap size can vary widely depending upon the application requirements and this table is only included to illustrate two examples of these configuration schemes.

Each total strap length includes two four inch fastening areas at each end of the strap. The middle portion of the strap length is the working flex area for each strap. For each strap length 14, 16, 18, 20, 24, 28, and 32 inches overall, the minimum and maximum working diameter for the centralizer is shown in Table 1. The data in Table 1. assumes a 2 inch outer diameter collar size.

TABLE 1

| WORKING RANGE | rise per side = | x2 straps at 180 degree apart + 2" o.d. collar = | spacer o.d. |
|---|---|---|---|
| STRAP CONFIGURATION #1 20" STRAP LESS 8" FASTENING AREA = 12" WORKING FLEX AREA | | | |
| MINIMUM | 2.5" | 5" | 7" |
| | 3" | 6" | 8" |
| | 3.5" | 7" | 9" |
| | 4" | 8" | 10" |
| | 4.5" | 9" | 11" |
| MAXIMUM | 5" | 10" | 12" |
| 24" STRAP LESS 8" FASTENING AREA = 16" WORKING FLEX AREA | | | |
| MINIMUM | 3.5" | 7" | 9" |
| | 4" | 8" | 10" |
| | 4.5" | 9" | 11" |
| | 5" | 10" | 12" |
| | 5.5" | 11" | 13" |
| | 6" | 12" | 14" |
| | 6.5" | 13" | 15" |
| MAXIMUM | 7" | 14" | 16" |
| 28" STRAP LESS 8" FASTENING AREA = 20" WORKING FLEX AREA | | | |
| MINIMUM | 4.5" | 9" | 11" |
| | 5" | 10" | 12" |
| | 5.5" | 11" | 13" |
| | 6" | 12" | 14" |
| | 6.5" | 13" | 15" |
| | 7" | 14" | 16" |
| | 7.5" | 15" | 17" |

TABLE 1-continued

| WORKING RANGE | rise per side = | x2 straps at 180 degree apart + 2" o.d. collar = | spacer o.d. |
|---|---|---|---|
| STRAP CONFIGURATION #1 20" STRAP LESS 8" FASTENING AREA = 12" WORKING FLEX AREA | | | |
| | 8" | 16" | 18" |
| | 8.5" | 17" | 19" |
| MAXIMUM | 9" | 18" | 20" |
| 32" STRAP LESS 8" FASTENING AREA = 24" WORKING FLEX AREA | | | |
| MINIMUM | 6.5" | 13" | 15" |
| | 7" | 14" | 16" |
| | 7.5" | 15" | 17" |
| | 8" | 16" | 18" |
| | 8.5" | 17" | 19" |
| | 9" | 18" | 20" |
| | 9.5" | 19" | 21" |
| | 10" | 20" | 22" |
| | 10.5" | 21" | 23" |
| | 11" | 22" | 24" |
| MAXIMUM | 11.5" | 23" | 25" |
| STRAP CONFIGURATION #2 18" STRAP LESS 8" FASTENING AREA = 10" WORKING FLEX AREA | | | |
| MINIMUM | 2.5" | 5" | 7" |
| | 3" | 6" | 8" |
| | 3.5" | 7" | 9" |
| MAXIMUM | 4" | 8" | 10" |
| 16" STRAP LESS 8" FASTENING AREA = 8" WORKING FLEX AREA | | | |
| MINIMUM | 2" | 4" | 6" |
| | 2.5" | 5" | 7" |
| | 3" | 6" | 8" |
| MAXIMUM | 3.5" | 7" | 9" |
| 14" STRAP LESS 8" FASTENING AREA = 6" WORKING FLEX AREA | | | |
| MINIMUM | 1.5" | 3" | 5" |
| | 2" | 4" | 6" |
| MAXIMUM | 2.5" | 5" | 7" |

Note:
Each strap has 4-inches fastening length at each end.

The present invention improves or provides the solutions to the many problems associated previously with centralizers. Just a few of those solutions described herein include simplifying and improving the locking mechanism of the straps into the collars, incorporating an adjustable centralizer to adapt to various diameter bore holes, improving the grout passage, and eliminating the need for use of conventional tools in assembly of the centralizer because of the use of a lightweight, flexible, and strong material. Now, many applications may be served by the present invention, instead of each application requiring a separately designed and manufactured centralizer device.

Consequently, while the foregoing description has described the principle and operation of the present invention in accordance with the provisions of the patent statutes, it should be understood that the invention may be practiced otherwise as illustrated and described above and that various changes in the size, shape, and materials, as well as on the details of the illustrated construction may be made, within the scope of the appended claims without departing from the spirit and scope of the invention.

What is claimed is:

1. A centralizer system comprising:

(a) two generally cylindrical collars;

(b) a plurality of strap members manually insertable into said collars;

(c) means for locking said strap members into said collars;

(d) means for adjusting said centralizer system into bore holes of various diameters; and (e) means for providing a plurality of grout passages in said collars.

2. A centralizer system according to claim 1, wherein said generally cylindrical collars are constructed so as to accept, and thereby be fixedly attached to, three or more of said strap members.

3. A centralizer system according to claim 2, wherein said collars and strap members are constructed of polyethylene material.

4. A centralizer system according to claim 1, wherein said strap members are constructed so as to integrally include three or more separate flexible portions.

5. A centralizer system according to claim 1, wherein said strap members include two lock hold pins.

6. A centralizer system according to claim 5, wherein said strap member lock hold pins include lock hold pin caps.

7. A centralizer system according to claim 1, wherein said strap members include gussets on one side, positioned within the non-flexible portion to provide strength and reinforcement to said strap member.

8. A centralizer system according to claim 1, wherein said strap members include two tapered rises at each end to facilitate attachment to said collars.

9. A centralizer system according to claim 1, wherein said strap members include one or more cable guides on each end for enhanced attachment to earth anchor rebar, corrugated pipe or cable mechanisms.

10. A centralizer system according to claim 9, wherein said strap member cable guides are radially cut to provide a tighter conformed attachment to rounded earth anchor mechanisms.

11. A centralizer system according to claim 1, wherein said means for adjusting said centralizer system into bore holes of various diameters includes the use of a component tool for holding said flexible strap members in a fixed position at the proper hole diameter for any given application, said component tool being supplied with each centralizer system unit.

12. A centralizer system according to claim 11, wherein said component tool is constructed of polyethylene.

13. A locking mechanism for a flexible centralizer system comprising:

(a) a plurality of manually flexible straps, two generally cylindrical collars, and a locking tool;

(b) each of said collars having a plurality of collar slots, each of said straps being manually insertable into said collar slots; and (c) each of said straps further comprising two slotted ends, a securing slot proximate to each of said slotted ends, two tapered rises located in general proximity to each of said slotted ends, and a set of locking pins located on a same edge of each of said straps and proximate to the center portion of each of said straps, yet distally separated from each other;

wherein each of said securing slots are cinched down to an earth anchor rebar, corrugated pipe or cable using securing means;

wherein said tapered rises allow said straps to be manually inserted into said collar slots, yet prevent said straps from easily being removed from said collar slots due to friction of said rises against said collar slots; and said locking tool being a narrow band of material having a plurality of punched holes at a first end of said tool, a single punched hole at a second end of said tool, wherein said tool is manually placed on said set of locking pins through said punched holes when said straps are under manual compression, whereby said straps are locked in position.

14. A locking mechanism for a flexible centralizer system according to claim 13, wherein said locking tool is constructed of polyethylene.

15. A locking mechanism for a flexible centralizer system according to claim 14, wherein said locking tool includes numbered holes for referencing a desired diameter for any given centralizer application.

16. An adjustable centralizer system comprising:

(a) a plurality of manually compressible straps, two generally cylindrical collars, and a locking tool;

(b) each of said collars having a plurality of collar slots, each of said straps being manually insertable into said collar slots;

(c) each of said straps further comprising two collar notches on a top side of each of said straps, said collar notches at the location of each of said collars, once said straps are inserted into said collars, and notches on the bottom side of each of said straps and in the central portion of each of said straps, and a set of lock hold pins located on a same edge of each of said straps and proximate to the center portion of each of said straps, yet distally separated from each other;

(d) said locking tool being a narrow band of material having a plurality of punched holes at a first end of said tool, a single punched hole at a second end of said tool, wherein said tool is manually placed on said set of locking pins through said punched holes when said straps are under manual compression; and said locking tool further being able to be placed over said lock hold pins in any one of said plurality of holes upon appropriate manual compression of said flexible straps;

whereby said centralizer system is adjustable to one of various diameters of anchor holes upon manual compression of said straps, whereby said straps flex, whereby said collar notches and said notches in the central portion of said straps flex, and said locking tool is adjusted by being placed over any appropriate one of said plurality of holes to allow said straps to be manually flexed outward to contact the diameter of the bore hole.

17. A method of using a centralizer system for centering an earth anchor mechanism within a bore hole comprising the steps of:

(a) providing a centralizer system having numerous collar and flexible strap members which are readily assembled on-site;

(b) sliding one or more of said centralizers onto a rebar, cable, bundle of cables or corrugated pipe encapsulated rebar or strand or other earth anchor mechanism;

(c) affixing one end of the centralizer to the earth anchor mechanism using a tie wire or tape or both;

(d) flexing said centralizer strap members to the proper diameter size for the application hole diameter specification and holding that proper size using a component tool;

(e) affixing the other end of said centralizer to the earth anchor mechanism using a tie wire or tape or both; and (f) continuing the process with other centralizers if any that have been slid onto said earth anchor mechanism, whereby said centralizers are proportionally spaced apart to hold said earth anchor mechanism in a centered position once lowered into a bored hole for accepting said earth anchor.

18. A method of using a centralizer system for centering an earth anchor mechanism within a bore hole according to claim 17, wherein said flexing step of said flexible centralizer includes manually flexing the centralizer device without the use of any conventional tools.

19. A method of using a centralizer system for centering an earth anchor mechanism within a bore hole according to claim 17, wherein said component tool includes a plurality of numbered holes for consistently referencing a given diameter to meet the specifications for centering within a bore hole.

20. A method of using a centralizer system for centering an earth anchor mechanism within a bore hole according to claim 17, wherein said centralizer unit and component tool are constructed of polyethylene.

* * * * *